US005759244A

United States Patent [19]

Tomlinson

[11] Patent Number: 5,759,244

[45] Date of Patent: Jun. 2, 1998

[54] CHROMATE-FREE CONVERSION COATINGS FOR METALS

[75] Inventor: Charles E. Tomlinson, Martinsville, Ind.

[73] Assignee: Natural Coating Systems, LLC, Martinsville, Ind.

[21] Appl. No.: 723,464

[22] Filed: Oct. 9, 1996

[51] Int. Cl.[6] ..... C23C 22/05; C23C 22/48

[52] U.S. Cl. ..... 106/14.14; 106/14.12; 106/14.15; 148/247

[58] Field of Search ..... 427/406, 405; 106/14.12, 14.13, 14.14, 14.15; 148/247

[56] References Cited

U.S. PATENT DOCUMENTS

| | | | |
|---|---|---|---|
| 3,609,110 | 9/1971 | Kumanotani . | |
| 3,964,914 | 6/1976 | Bullock et al. | 106/14.13 |
| 4,338,140 | 7/1982 | Reghi | 148/6.14 R |
| 4,339,310 | 7/1982 | Oda et al. | 106/14.12 |
| 4,341,558 | 7/1982 | Yashiro et al. | 106/14.12 |
| 4,462,842 | 7/1984 | Uchiyama et al. | 148/6.15 R |
| 4,470,853 | 9/1984 | Das et al. | 148/6.15 Z |
| 4,762,619 | 8/1988 | Gaddis et al. | 427/245 |
| 4,851,293 | 7/1989 | Egerton et al. | 427/214 |
| 4,863,706 | 9/1989 | Wada et al. | 423/277 |
| 5,114,890 | 5/1992 | Peterson | 106/38.9 |
| 5,211,663 | 5/1993 | Kovacs et al. | 427/2.27 |
| 5,362,573 | 11/1994 | Pandian et al. | 427/342 |
| 5,380,374 | 1/1995 | Tomlinson | 148/247 |
| 5,397,390 | 3/1995 | Gorecki | 106/287.11 |
| 5,441,580 | 8/1995 | Tomlinson | 148/247 |
| 5,449,415 | 9/1995 | Dolan | 406/14.12 |
| 5,516,511 | 5/1996 | Motley et al. | 424/65 |
| 5,531,820 | 7/1996 | Gorecki | 427/387 |

FOREIGN PATENT DOCUMENTS 1 504 494 1/1977 United Kingdom .

OTHER PUBLICATIONS

188th Meeting Program for The Electrochemical Society, Inc. including Abstracts of speakers/programs to be conducted. Oct. 8–13, 1995.

*Primary Examiner*—Diana Dudash
*Attorney, Agent, or Firm*—Locke Reynolds

[57] ABSTRACT

An aqueous acidic composition for providing improved corrosion resistance and improved paint adhesive to metals; e.g., ferrous, aluminum, or magnesium alloys; upon contact. The composition comprises a Group IV-A metal such as zirconium in an acidic solution with one or more oxyanions to stabilize and solubilize the metal while fluorides and organic solvents are specifically excluded from the composition. The coating is at a pH below about 5.0 and is preferably in a range between about 1.0 and about 4.0. The coating may contain surfactants, sequestering agents, or organic additives for improved corrosion protection and paint adhesion. The substrate may be treated by immersion, spray, fogging or rollcoat.

17 Claims, 1 Drawing Sheet

Figure 1: Proposed attachments of Zr to aluminum oxide, providing "activation."

Figure 1: Proposed attachments of Zr to aluminum oxide, providing "activation."
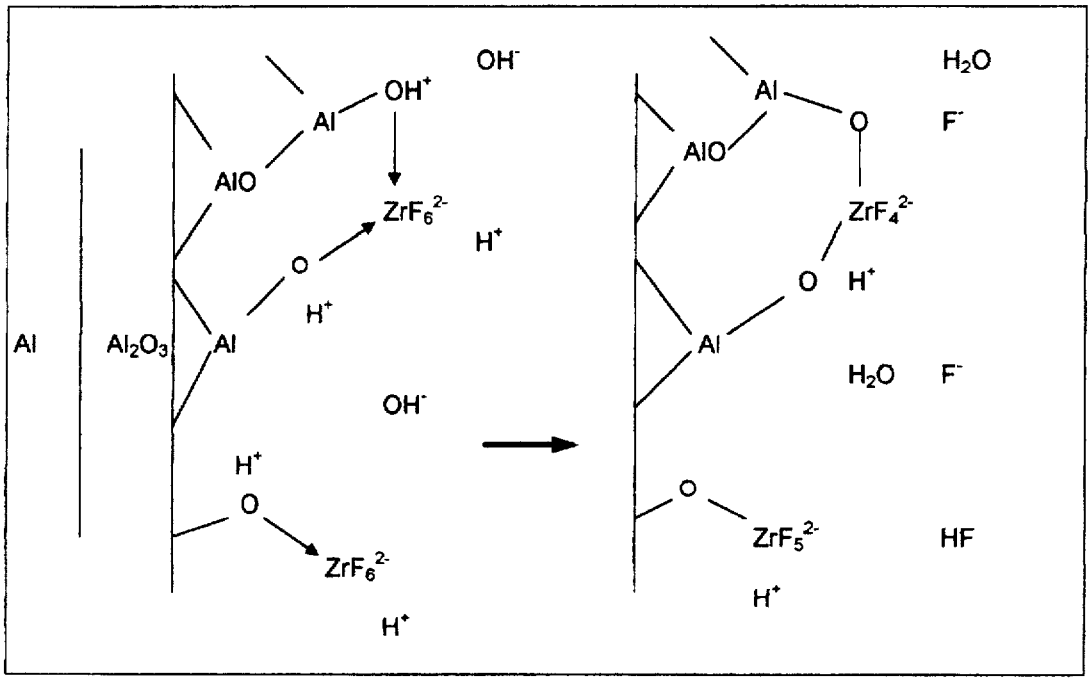

CHROMATE-FREE CONVERSION COATINGS FOR METALS

FIELD OF THE INVENTION

The present invention relates generally to conversion coatings for metal surfaces, and more particularly to coatings that are particularly useful for steel, magnesium and aluminum surfaces.

BACKGROUND AND SUMMARY OF THE INVENTION

In recent years a need has arisen for coating compositions that will function to replace chromates in metal treatment. This is due to the detrimental health and environmental impact that has been determined to be associated with chromium compounds.

Many chromate-free chemical conversion coatings for metal surfaces are known to the art. These are designed to render a metal surface "passive" (or less "reactive" in a corrosive environment), leaving the underlying metal protected from the environment. Coatings of this type that produce a corrosion resistant outer layer on the base metal or its oxide often simultaneously produce a surface with improved paint adhesion. Conversion coatings may be applied by a no-rinse process, in which the substrate surface is treated by dipping, spraying, or roll coating. The coatings may also be applied in one or more stages that are subsequently rinsed with water to remove undesirable contaminants.

Several metal and metaloid elements will form a continuous three-dimensional polymeric metal- or metaloid-oxide matrix from aqueous solutions. Chromium shares this characteristic along with silicon and other elements. The Group IV-A elements are attractive candidates for chromate replacement technologies as are the stannates as they share the virtue of being relatively innocuous environmentally and have common valences of +4, facilitating the formation of three dimensional amorphous coatings.

Chromate-free conversion coatings are generally based on chemical mixtures that in some fashion will react with the substrate surface and bind to it to form protective layers. The layer or layers may yield protection through galvanic effects or through simply providing a physical barrier to the surrounding environment.

Many of these conversion coatings have been based on Group IV-A metals such as titanium, zirconium and hafnium, a source of fluoride and a mineral acid for pH adjustment. The fluoride has heretofore generally been considered to be necessary to maintain the Group IV-A metal in solution as a complex fluoride. The fluoride may also serve to keep dissolved substrate metal ions (such as aluminum) in solution.

For example, U.S. Pat. No. 4,338,140 to Reghi discloses a coating for improved corrosion resistance with solutions containing zirconium, fluoride and tannin compounds at pH values from 1.5 to 3.5. Optionally, the coating may contain phosphate ions. U.S. Pat. No. 4,470,853 to Das is related to a coating composition comprised of zirconium, fluoride, tannin, phosphate, and zinc in the pH range of 2.3 to 2.95. According to Das, it is important that approximately 10 atomic percent of zirconium-zirconium oxide be present in the coating to obtain "TR-4" corrosion resistance. It was shown that coatings of higher zirconium oxide content produced excellent corrosion resistance. Compositions which gave higher zirconium oxide on the surface were preferred in the disclosures.

U.S. Pat. No. 4,462,842 to Uchiyama and U.S. Pat. No. 5,380,374 to Tomlinson disclose zirconium treatments in solutions containing fluorides which are followed by treatment with silicate solutions. This combination is suggested to form zirconate and syloxyl linkages (—O—Zr—O—Si—O—Si— . . . ), yielding a coating with improved corrosion resistance over the zirconium treatment alone. Coatings of this type give excellent corrosion protection but very poor paint adhesion.

U.S. Pat. No. 4,863,706 to Wada discloses a process for producing sols and gels of zirconium and a process for producing zirconia. The processes described include reactions to produce basic boratozirconium and basic boratozirconium chloride sols. These are disclosed to be used in producing boratozirconium and boratozirconium chloride gels. A further object of the disclosure is to describe a method for producing zirconia from the gels at relatively low temperature. The essential components of the invention include a boron compound along with a polyvalent metal, zirconium and chloride.

U.S. Pat. No. 5,397,390 to Gorecki discloses an adhesion promoting rinse containing zirconium in combination with one or more organosilanes and fluoride. The compositions are used to rinse surfaces after they have been treated in a phosphating bath. The zirconium ion concentration is selected to maintain pH in a broad range as the silanes deposit on the substrate to promote paint adhesion and improve corrosion resistance. Organosilanes are necessary components of the disclosed compositions. Additionally, in preparing the compositions, Gorecki indicates that whenever zirconium-containing salts such as zirconium basic carbonate, zirconium hydroxychloride and zirconium oxychloride are used as a source (of zirconium) the salts must be dissolved in 50% hydrofluoric acid in order to effect dissolution. Gorecki does not indicate a necessity to dissolve the fluorozirconate salts mentioned in his disclosure. This demonstrates that fluoride is a necessary component of the disclosed compositions as it is included as part of the fluorozirconate salts or from hydrofluoric acid. Compositions of this nature are among the group of fluorozirconates which are referred to herein below as useful for "activating or activation" of a surface prior to application of the present invention.

Brit. Pat. 1,504,494 to Matsushima describes a process for treating metal surfaces using zirconium at a pH above 10.0. A zirconate coating is formed but the pH of the solution is maintained above the present invention.

It can be seen from the foregoing that the compositions of the prior art have not used Group IV-A metals in an aqueous, non-organic solvent containing systems that exclude fluoride specifically. Additionally, the prior art does not show formation and attachment of zirconate gels from aqueous solution without using organic solvents. Sol-gels are macromolecular units rather than discrete atoms or molecular units and are typically prepared from metal-alkoxy precursors in solvent-based solutions that are unstable in water.

The present invention employs an organic or inorganic oxyanion to stabilize zirconium ions in an aqueous acidic solution with subsequent exposure of a metal substrate to the solution and with subsequent drying to produce a barrier of zirconium oxide coating. The prior art has demonstrated the usefulness of fluoride in compositions containing Group IV-A metals but has not shown the advantages of its exclusion from compositions containing these metals. Many benefits of eliminating fluoride have been addressed in systems based on chemistries other than those of the Group IV-A metals. Examples are described in UK Pat. Application 2,084,614 by Higgins.

In the present invention, the zirconium (or other Group IV-A element) atoms are believed to bond to active oxygen atoms on the substrate surface, leading to a thin zirconate film forming from a reaction analogous to the reaction of silicates. Without rinsing the substrate before drying, the zirconate in the coating solution carried out with the substrate will bond to the thin film upon drying. Whereas silica "gels" form from alkaline solutions upon exposure to an acidic surface or one high in mono- and polyvalent cations, zircon "gels" will form on surfaces which are acidic or basic and those high in mono- and polyvalent cations. Upon drying at room or elevated temperature, a continuous polymeric zirconium oxide becomes fixed on the surface.

The present compositions will give improved corrosion protection over zirconates containing fluoride. This is believed to be due to the fluoride competing with oxygen for bonding to zirconium in the matrix. With an atomic ratio of fluoride to zirconium at or between two to one and zero to one, the probability that all zirconium atoms will incorporate in the coating as a second or higher order oxide is very high. The term "order" is used here to describe the number of bonds a given Group IV-A element has to another element such as oxygen or fluorine; i.e. a second order zirconium fluoride has zirconium bonded to two fluorine atoms, a third order zirconium-oxygen compound has three zirconium to oxygen bonds, etc. With no fluoride present to compete with the oxygen, a three-dimensional zirconyl matrix with each zirconium atom bonded with up to four oxygen atoms will be established. Naturally occurring zirconates having this character are among the hardest, oldest and most stable inorganic compounds known.

The present invention may be used in processes where fluoride is used in preceding stages. This may cause accumulation of fluoride in the compositions of the present invention in some systems during processing. Fluoride may be tolerated in such cases up to a ratio not exceeding two fluoride atoms per Group IV-A atom in solution. It is to be understood that the presence of such fluoride is undesirable for compositions and processes described here but that such systems are still preferred to those with higher fluoride levels. In the prior art, fluoride is typically used at a ratio of at least four fluoride atoms per Group IV-A atom.

It should be further noted that the zirconate coatings containing fluoride are inferior to the same which are subsequently treated with silicate solutions. This indicates the silicate itself is superior to the fluorozirconates for protection and while the fluorozirconates give some benefit, they act primarily as a surface activator and attachment device for the silicate layers.

The present invention will provide improved, highly corrosion resistant conversion coatings based on Group IV-A metals such as zirconium by combining the Group IV-A metal with a stabilizing anion other than fluoride in acidic solution. The presence of fluoride in the solution is undesirable but may be tolerated up to a ratio of two fluoride atoms per Group IV-A atom.

In one aspect of the invention, the zirconium content of the solution is 1,000 to 20,000 ppm, 500 to 15,000 ppm nitrate and 1,000 to 7,000 ppm tris(hydroxymethyl) aminomethane; the preferred pH of the solution will be between about 1.0 and 4.0. The coating may optionally include Group IA and/or Group IIA elements, ethanol amines, organic acids such as acetic acid, sequestering agents, and chelants to inhibit precipitation caused by mono- and polyvalent metal ions that may build up in the coating solution.

One object of the invention is to provide improved Group IV-A conversion coatings for steel, magnesium and aluminum that are both highly corrosion resistant and simultaneously serve as an adhesion promoting paintbase. This is characteristic of chromate conversion coatings, but environmentally safe silicate coatings generally reduce paint adhesion.

An additional benefit of the invention is that the coating is formed from an aqueous solution with no organic solvents used. This eliminates the disposal and emission considerations involved in producing zirconates and other metal oxide-containing coatings from sol-gel applications, while providing a broad spectrum replacement for chromates.

Further objects and advantages of the present invention will be apparent from the following description and accompanying drawing.

BRIEF DESCRIPTION OF THE DRAWING

FIG. 1 schematically illustrates attachment/activation of zirconate to aluminum oxide.

DESCRIPTION OF THE PREFERRED EMBODIMENT

For the purpose of promoting an understanding of the principles of the invention, reference will now be made to preferred embodiments and specific language will be used to describe how to make the best mode of the invention. It will nevertheless be understood that no limitation of the scope of the invention is thereby intended, such alterations and further modifications in the illustrated embodiments, and such further applications of the principles of the invention as illustrated herein being contemplated as would normally occur to one skilled in the art to which the invention pertains.

As indicated above, the present invention relates generally to chromate-free compositions which provide a highly corrosion resistant coating on the surface of metal substrates. It is believed that the most significant source of corrosion protection would come from a zirconyl matrix that is analogous to a siloxyl network. Such siloxyl networks have been shown to be produced from alkaline silicate solutions upon their contact with an acidic surface followed by drying. The zirconium based matrix is formed when the compositions are dried onto a surface. The zirconyl matrix will be composed of $—O—Zr[—O—]_3—Zr[—O—]_3—Zr[—O—]_3$ structures that make up a three dimensional "zirconate polymer."

The invention is believed to be most efficacious when two or more stages are used. The fluoride-free or low fluoride zirconate solution is the final stage and it is preferred that no rinse be used prior to drying. Stages prior to the zirconate are included to prepare the substrate surface by cleaning and/or activation. The activation can include deoxidization, application of other types of coatings (chromate, or chromate-free as proposed in FIG. 1 for a zirconium fluoride attachment to an aluminum oxide surface) or a simple cleaning (with a cleaning agent such as a surfactant or a solvent degrease) or activation treatment of the naturally occurring oxide that exists on most metals. It is preferred that the surface be clean and the natural oxide remain intact prior to the present invention's application (and be activated in some fashion) as it will promote additional protection from a corrosive environment. It is preferred that the cleaning stage be the activation stage or to be the stage prior to the activation stage.

A multiple stage process is preferred, as improved bonding of the zirconyl matrix to the surface will be obtained when there has been an activation stage. The most preferred is a two stage process wherein the first stage contains zirconium and fluoride. The fluoride acts to activate the metal oxide surface and the zirconium bonds, facilitating the subsequent zirconyl film formation and attachment. A thorough deionized rinse prior to the final "zirconyl stage" is most desirable. Contamination of the "zirconyl stage" with prior treatment solutions is to be avoided as they may induce premature gellation when rising to excessively high levels. This is to be avoided as the treatment bath will be induced to completely and irreversibly gel in the treatment tank.

In one aspect of the present invention, a corrosion resistant conversion coating is provided comprising a Group IV-A metal such as titanium, zirconium or hafnium and an oxyanion such as nitrate, sulfate, acetate, etc., that will coordinate with zirconium but not form stable covalent metal-oxide bonds. The pH of the solution is preferably below about 5.0, preferably between about 1.0 and about 4.0, and most preferably between 1.5 and 3.5. To adjust the pH to lower levels, it is preferred to use the corresponding acid of the oxyanion, and to raise the pH of a solution, it is preferred to use a metal-free organic base such as tris (hydroxymethyl)aminomethane.

At increasing pH values, Group IV-A elements tend to form higher order hydroxides through hydrolysis. In the prior art, fluoride anion has been used to compete with hydroxides and hydroxide donors to inhibit formation of Group IV-A metal hydroxides. The stabilizing oxyanions become displaced and various hydroxide species form according to the following reaction, as seen, for example, for zirconium:

$$Zr^{4+}+nH_2O \rightarrow Zr(OH)_n^{+4-n}+nH^+$$

The higher order hydroxide will, in turn, tend to form $ZrO_2$ which is undesirable because it is insoluble. At a pH of about 4.5 to 5.0 or higher, $Zr(OH)_4$ begins to increasingly predominate, leading to the formation of zirconium oxide through a dehydration reaction. Higher levels of acid in solution (low pH values) push the equilibrium of this reaction to the left and, with sufficient oxyanion present, $Zr^4+$ remains soluble in solution and does not precipitate as the hydroxide formed by hydrolysis.

A proton from an acid can be considered to be competitive with the zirconium ion for a hydroxyl unit, yielding water and a soluble zirconium/hydroxyllanion complex. This can be expressed by (with OA representing an oxyanion):

$$Zr(OH)_x^{+4-x}+nH^++mOA^{y-} \rightarrow Zr(OH)_{x-m}(OA)_m^{+4-m[y]-(x-m)}+nH_2O$$

Addition of an acid such as nitric is ideal for this as hydrogen ion is added along with nitrate, so, for example:

$$Zr(OH)_x^{+4-x}+nHNO_3 \rightarrow Zr(OH)_{x-n}(NO_3)_n^{+4-n(x-n)}+nH_2O$$

Without high levels of fluoride, the acid and coordinating oxyanion levels must be kept such that the pH is below about 5.0 and the anion is maintained at a level that it helps to form a soluble coordinate complex with the Group IV-A metal. The nature of the oxyanion is important as relatively weak Lewis bases will coordinate with the metal but also allow it to easily form a coating when exposed to a substrate surface. So, the one oxyanion that is undesirable to add directly in these applications is the very strong Lewis base of hydroxide ion, as it will consume hydrogen ion and begin to compete with the preferred oxyanions for coordination or attachment to the Group IV-A metals. This competition becomes increasingly strong (or more favorable) for hydroxide as pH goes up, reflecting a higher hydroxide concentration (and lower hydronium ion) and, therefore, higher probability of higher order Group IV-A metal hydroxides forming. This, in turn, leads to premature gellation or formation of the insoluble dioxides ($TiO_2$, $ZrO_2$ and $HfO_2$) through dehydration reactions.

The source of the oxyanion may be from various salts such a potassium nitrate, potassium nitrite, sodium sulfate, sodium acetate and others, but it is preferred that the solution have minimal levels of cations (such as potassium), other than those from Group IV-A. Therefore, preparation of the zirconium solution should be performed with zirconium in the form of the carbonate or other relatively pure form such as the metal in combination with the acid form of the anion. Nitric acid, sulfuric acid, boric or acetic acid and other "O-donor" acids are suitable for combining with forms such as the carbonate. Solubilities and reaction time will depend upon the acid used. Nitric acid will react quickly and give high solubility, whereas boric acid will react slowly and give low solubility. Nitrates, sulfates and other salts of Group IV-A metals are available and may be used while subsequently lowering pH, when necessary, using the corresponding acid. Increasing pH is preferably done using a metal-free base, preferably an organic oxygenaceous or nitrogenous Lewis base, such as tris(hydroxymethyl)aminomethane ("Tris"). Use of Tris is preferred in one embodiment as it will act as a chelant as well as 2 buffer. Use of the corresponding oxyacid with carbonates of zirconium is most preferred.

As indicated, the Group IV-A metal may be titanium, zirconium or hafnium. In most applications zirconium is used, due primarily to its commercial availability and lower cost. Additionally, solutions prepared with titanium would generally have to be more dilute than zirconium and hafnium due to its lower solubility.

The levels of acid, anion, and chelants such as ethylenediaminetetraacetic acid, which is commonly available under the trade name of Versenexs, are maintained to keep the metals in solution.

As silicates tend to gel readily below a pH of 10, it is expected that the zirconates in the presence of oxyanions will behave analogously above a pH of about 4.5 to 5.0. Therefore, to be in a pH range where gellation is facilitated yet the solution is stable, a pH of 1.0 to 4.0 will be most appropriate. As with silicates, the presence of cations (particularly polyvalent) promotes gellation and are acceptable in the coating solution to a limited extent, but are preferred to be introduced to the surface of the treated substrate prior to its exposure to the present invention. Therefore, in one embodiment, a pretreatment stage is used to accomplish this.

As with most conversion coatings, an elevated temperature of the treatment solution accelerates coating deposition. Silicates at 10% by weight in water have shown to form a coating in less than five minutes from 70° to 120° F. The higher temperature ensures completeness of reaction and a range of 100° to 130° F. is preferred in one embodiment of the present invention. Appropriate working solution temperatures for particular applications may be selected by persons skilled in the art and are not limited to the ranges described herein.

Acceptable coatings will form from solutions up to the solubility limit of the metals at a given pH. In the preferred range of pH, the best levels can be determined without undue experimentation by persons skilled in the art. In one embodiment, the coating will form with zirconium at $2.0\times10^{-1}$M and nitrate at $2.0\times10^{-1}$M. The best concentration of metal, nitrate, pH, and organic base will depend upon working bath temperature, method of application, substrate, etc.

Additional components may be added to enhance particular characteristics, such as paint adhesion or more rapid coating deposition. These would include phosphates, tannins, various metal cations and organic acids. Addition of oxides of elements such as tungsten may be useful in certain applications as they will incorporate into the matrix and modify the thermal stress characteristics of the coating. Studies of zirconium-tungsten oxides have shown geometric expansion upon cooling which can relieve stress crack formation in the coatings as they cool when they are dried at elevated temperature. Use of any additive will need to be balanced with how it destabilizes the coating solution. Generally, as with other zirconate type coatings, where higher levels of acid help to maintain solubility of bath components, additional acid may be needed to stabilize the coating solution. Incorporation of stannates is also attractive as a structural component and should be of particular value when treating ferrous alloys.

Working solutions composed of mixture(s) of the above components may be applied by spray, dip, and roll coat application. After the coating has been allowed to form, it may be rinsed, but a "no-rinse" process is preferred. The Group IV-A components that remain on the surface and are not rinsed off will become incorporated into the coating as it dries. There is an additional benefit in that coating components in solution are not rinsed into the waste stream of the processing facility. A chemical treatment stage may be used after the described treatment to further modify the coating's characteristics. This could include silicating, a sequence of Group IV-A coatings, among others.

It is appreciated that siccative coatings which form an organic barrier may also be necessary for decorative or other finishing characteristics of the product. The adhesion will be far superior to that seen with silicates as the resultant surface will be acidic rather than alkaline, and fluorozirconates are commonly coated on metals to improve paint adhesion, particularly adhesion of oxygenated polymers such as epoxies and esters. Many of these finishes are commonly applied through electrostatic (e-coat) means. As with conventional application methods, improved adhesion performance would be expected in electrostatic applications.

Reference will now be made to proposed specific examples and how each would improve performance in several applications. It is to be understood that the examples are provided to more completely describe preferred embodiments, and that no limitation to the scope of the invention is intended.

EXAMPLE 1 (E1)

A zirconate conversion coating solution was prepared with distilled water as follows. Zirconium carbonate in 100 mL distilled water (55 grams of $3ZrO_2CO_2.xH_2O$ [assay ~40% as $ZrO_2$] providing approximately 16.2 grams zirconium) and nitric acid (10 mL of 42° Be, at ~67.2% w/w providing approximately 9.3 grams nitrate) were mixed with gentle warming. After the carbonate was completely dissolved, the pH of this solution was less than 1.0. The solution was brought up to 1.0 liter with distilled water. The final pH of this solution was approximately 1.7. This solution was used at 120° F.

EXAMPLE 2 (E2)

A solution was prepared as in EXAMPLE 1 along with tris (hydroxymethyl)amino-methane (5.0 grams) to yield a solution having a final pH of approximately 2.4. This solution was used at 120° F.

-continued

EXAMPLE 3 (E3)

A solution was prepared as in EXAMPLE 1 using one fifth the levels zirconium carbonate and nitric acid along with 5.0 grams tris(hydroxymethyl)aminomethane. The resulting pH was approximately 3.0. This solution was used at 120° F.

The solutions in EXAMPLES 1 to 3 were used to coat aluminum 3003 panels. Panels were pretreated with the following solutions for five minutes. Pretreated panels were either rinsed in distilled water and then dried (controls) or rinsed in distilled water, treated with one of each of the above Example solutions and dried. All panels were dried at 225° F. for five minutes. Temperatures and other conditions are given with each.

Pretreatment A (PA)

Distilled water soak at 70° F. for five minutes.

Pretreatment B (PB)

A soak at 70° F. for five minutes in a solution of potassium fluoride (1.2 grams per liter) and 42° Be nitric acid (approximately 0.5 mL) at a pH of about 2.8 in distilled water.

Pretreatment C (PC)

A soak at 120° F. for five minutes in the following solution. A mixture brought to one liter with distilled water and 0.5 gram $K_2ZrF_6$, 0.2 grams $Na_2B_4O_7.5H_2O$, and 0.3 grams sodium tripolyphosphate. The pH of this solution was brought to about 2.8 with approximately 0.20 mL 42° Be nitric acid.

All panels were dried as described above. Treatment codes are given in Table 1 below. Panels coated with each pretreatment and combined pretreatment/Example 1, 2 or 3 were tested bare and painted. Tests included seven days (168 hours) exposure to neutral salt spray according to ASTM B-117 and paint adhesion before and after 168 hours of salt spay exposure according to ASTM D-3359 (ratings range from 5 [no loss of adhesion] to 0 [greater than 65% adhesion loss]) using a 1.5 mm crosshatch tool. Results are given in Table 2 below. Painted panels were sprayed with an enamel paint and allowed to air dry for 30 minutes. Thereafter the panels were dried in an oven at 170° F. for 15 minutes to fully cure the paint.

TABLE 1

Treatments

| | Treatment Order | | | | | |
|---|---|---|---|---|---|---|
| Coating Code | Pre-treat A | Pre-treat B | Pre-treat B | EXAMPLE 1 | EXAMPLE 2 | EXAMPLE 3 |
| PA | 1 | — | — | — | — | — |
| PA/E1 | 1 | — | — | 2 | — | — |
| PA/E2 | 1 | — | — | — | 2 | — |
| PA/E3 | 1 | — | — | — | — | 2 |
| PB | — | 1 | — | — | — | — |
| PB/E1 | — | 1 | — | 2 | — | — |
| PB/E2 | — | 1 | — | — | 2 | — |
| PB/E3 | — | 1 | — | — | — | 2 |
| PC | — | — | 1 | — | — | — |
| PC/E1 | — | — | 1 | 2 | — | — |
| PC/E2 | — | — | 1 | — | 2 | — |
| PC/E3 | — | — | 1 | — | — | 2 |

TABLE 2

Test results for corrosion and adhesion.

| Coating | % Pitting over panel after exposure to neutral salt spray according to ASTM B-117 | | | Crosshatch adhesion according to ASTM D-3359 | |
|---|---|---|---|---|---|
| Code | 1 day | 3 days | 7 days | Before Salt Spray Exposure | After Salt Spray Exposure |
| PA | 40 | 80 | 100 | 4 | 2 |
| PA/E1 | 0 | 20 | 40 | 5 | 5 |
| PA/E2 | 0 | 0* | 0* | 5 | 5 |
| PA/E3 | 0 | 0 | 0 | 5 | 4 |
| PB | 60 | 100 | 100 | 5 | 4 |
| PB/E1 | 10 | 20 | 50 | 5 | 5 |
| PB/E2 | 10 | 30 | 50 | 5 | 5 |
| PB/E3 | 10 | 30 | 60 | 5 | 4 |
| PC | 10 | 60 | 100 | 4 | 3 |
| PC/E1 | 0 | 0* | 0* | 5 | 5 |
| PC/E2 | 0 | 0 | 0* | 5 | 5 |
| PC/E3 | 0 | 0 | 0 | 5 | 3 |

*Panels show spots that evidence some potential disruption, but no distinct pits have formed.

I claim:

1. A chromium-free aqueous composition for coating metal surfaces with a Group IV oxide matrix to improve corrosion protection comprising:

a. between about $2.0\times10^{-4}$ moles per liter and about 2.0 moles per liter, based on the aqueous composition, of dissolved Group IV-A metal ions selected from the group consisting of titanium, zirconium and hafnium alone or in combination;

b. at least one or more mono- or polyvalent oxyanions (excluding silicate anions) in a mole ratio of about 0.5 or more moles of anion per mole of dissolved Group IV-A metal;

c. sufficient hydrogen ion to maintain the solution pH below about 5.0;

d. fluoride atoms which are optionally present in a ratio of no more than zero to 2 fluoride atoms per Group IV-A metal ion, and e. water, the composition forming a Group IV oxide matrix on a surface of a metal to which the composition is applied.

2. An aqueous composition according to claim 1 wherein the Group IV-A metal comprises zirconium.

3. An aqueous composition according to claim 1 wherein the hydrogen ion and the oxyanion are added as a corresponding conjugate acid-base pair.

4. An aqueous composition according to claim 1 wherein the oxyanion is added in the form of an oxysalt of a Group IV-A metal.

5. A coating composition according to claim 1 wherein the Group IV-A metal is present in a concentration of between about 0.02 moles per liter and about 0.4 moles per liter, based on the aqueous composition, of dissolved Group IV-A metal ions.

6. A coating composition according to claim 1 wherein the oxyanion is present in a concentration of between about 0.01 moles per liter and about 3.2 moles per liter, dependent upon the aqueous composition of dissolved Group IV-A metal ions, to give a mole ratio between about 0.5:1 and about 8:1 oxyanion to Group IV-A metal ion.

7. A coating composition according to claim 1 wherein the hydrogen ion comprises hydronium ion in a concentration sufficient to provide a pH between about 1.5 and about 3.5.

8. A coating composition according to claim 1 prepared from zirconium carbonate and an oxyacid.

9. A coating composition according to claim 1 further comprising a chelant which complexes polyvalent metals other than or in addition to Group IV-A metals.

10. A composition according to claim 9 wherein the chelant comprises ethylenediaminetetraacetic acid.

11. A coating composition according to claim 1 further comprising a pH modifier, including an organic Lewis base.

12. A coating composition according to claim 11 wherein the modifier comprises tris(hydroxymethyl)aminomethane.

13. A coating composition according to claim 12 wherein the tris(hydroxymethyl)aminomethane is present in sufficient quantity to provide a pH between about 1.5 and about 3.5.

14. A coating composition according to claim 1 wherein metal cations other than from Group IV-A are added to induce gellation of the coating solution on a surface.

15. A coating composition according to claim 1 further comprising metal and metaloid oxides including borates, stannates, phosphates or tungstates are added to improve structural stability, corrosion protection or paint adhesion characteristics of the formed coating.

16. A coating composition according to claim 1 wherein the oxyanion is polyvalent.

17. A coating composition according to claim 1 wherein the oxyanion comprises a Lewis base.

* * * * *